US005828183A

United States Patent [19]

Wang et al.

[11] Patent Number: 5,828,183

[45] Date of Patent: Oct. 27, 1998

[54] FLASHING CONTROL CIRCUIT FOR DECORATIVE LIGHT STRING

[76] Inventors: Dennis Wang; Jessica Wang, both of 4F-3, No. 77, Sec. 2, Tun Hwa South Road, Taipei, Taiwan

[21] Appl. No.: 975,950

[22] Filed: Nov. 12, 1997

[51] Int. Cl.[6] ..... H05B 41/00

[52] U.S. Cl. ..... 315/185.5; 315/323; 362/806

[58] Field of Search ..... 362/251, 806; 315/185 S, 200 A, 312, 323, 324, 325, 185 R, 189, 192

[56] References Cited

U.S. PATENT DOCUMENTS 4,713,586 12/1987 Chiang ..... 315/200 A

*Primary Examiner*—Robert J. Pascal
*Assistant Examiner*—David H Vu

[57] ABSTRACT

A flashing control circuit for a decorative light string is disclosed. The flashing control circuit includes a number of flashing control bulbs arranged on the decorative light string sequentially at a suitable interval. Each of the flashing control bulbs are electrically connected with a series light string which includes a number of light bulbs connected in series. All the light bulbs are arranged on the decorative light string sequentially at interval according to the arranged sequence of the flashing control bulbs.

2 Claims, 3 Drawing Sheets

FLASHING CONTROL CIRCUIT FOR DECORATIVE LIGHT STRING

BACKGROUND OF THE INVENTION

1. Field of the Invention

The present invention relates to a decorative light string, and more particularly to a flashing control circuit for a decorative light string.

2. Description of the Prior Art

Christmas light strings are widely used as decorative light strings for decorative purposes. FIG. 1 of the attached drawings shows an example of a conventional decorative light string, which comprises a first electric power cord L1, a second electric power cord L2, a number of connecting cords L3, a number of bulb stands 3, and a number of light bulbs 4. The first electric power cord L1, the second electric power cord L2, and the connecting cords 3 are twisted together to form a light string. Each of the bulb stands 3 may receive and hold a light bulb 4 thereon. Typically, the light bulbs arranged on the light string are electrically connected in series to form a series circuit loop.

An electric plug 1 may be provided at one end of the light string for connection with an external power source (not shown). Further, an electric socket 2 may be connected at the other end of the light string to provide an electrical connection to another light string to form an extendible long light string. The light string may be attached to any desired article or object, such as a tree, a window or a curtain. The arrangement of the light string on an article may be in any arbitrary pattern by fixing the wires and the bulb stands to the article and to themselves.

For providing a flashing feature to the light string, one of the light bulb on the light string may be replaced with a known flashing control bulb which is capable of controlling the conductive status of electric current through the series circuit loop of the light string. However, this prior art product has a disadvantage of simple flashing feature. The light bulbs of the series circuit loop are simply turned on or off according to the conductive status of the flashing control bulb. It is obvious that this prior art light string can not provide a versatile flashing effects. Besides, in order to provide a more versatile flashing control to the light string, it is necessary to connect a number of light strings by plugging the electric plug of a next stage light string to the electric socket of the previous stage light string to form a long light string, which will increase the cost.

SUMMARY OF THE INVENTION

Consequently, the primary object of the present invention is to provide a flashing control circuit for a Christmas light string without need of complicated control circuits.

The other object of the present invention is to provide a Christmas light string with versatile flashing control features. The flashing features of the present invention are achieved by a simple circuit arrangement which includes a number of flashing control bulbs and a number of series light strings controlled by the flashing control bulbs.

In order that the present invention may more readily be understood, the following description is given, merely be way of example, reference being made to the accompanying drawings, wherein:

DETAIL DESCRIPTION OF THE PREFERRED EMBODIMENT

Reference will now be made in detail to the preferred embodiment of the present invention, examples of which are illustrated in the accompanying drawings. Wherever possible, the same reference numbers will be used throughout the drawings to refer to the same or like parts.

Figure 1:
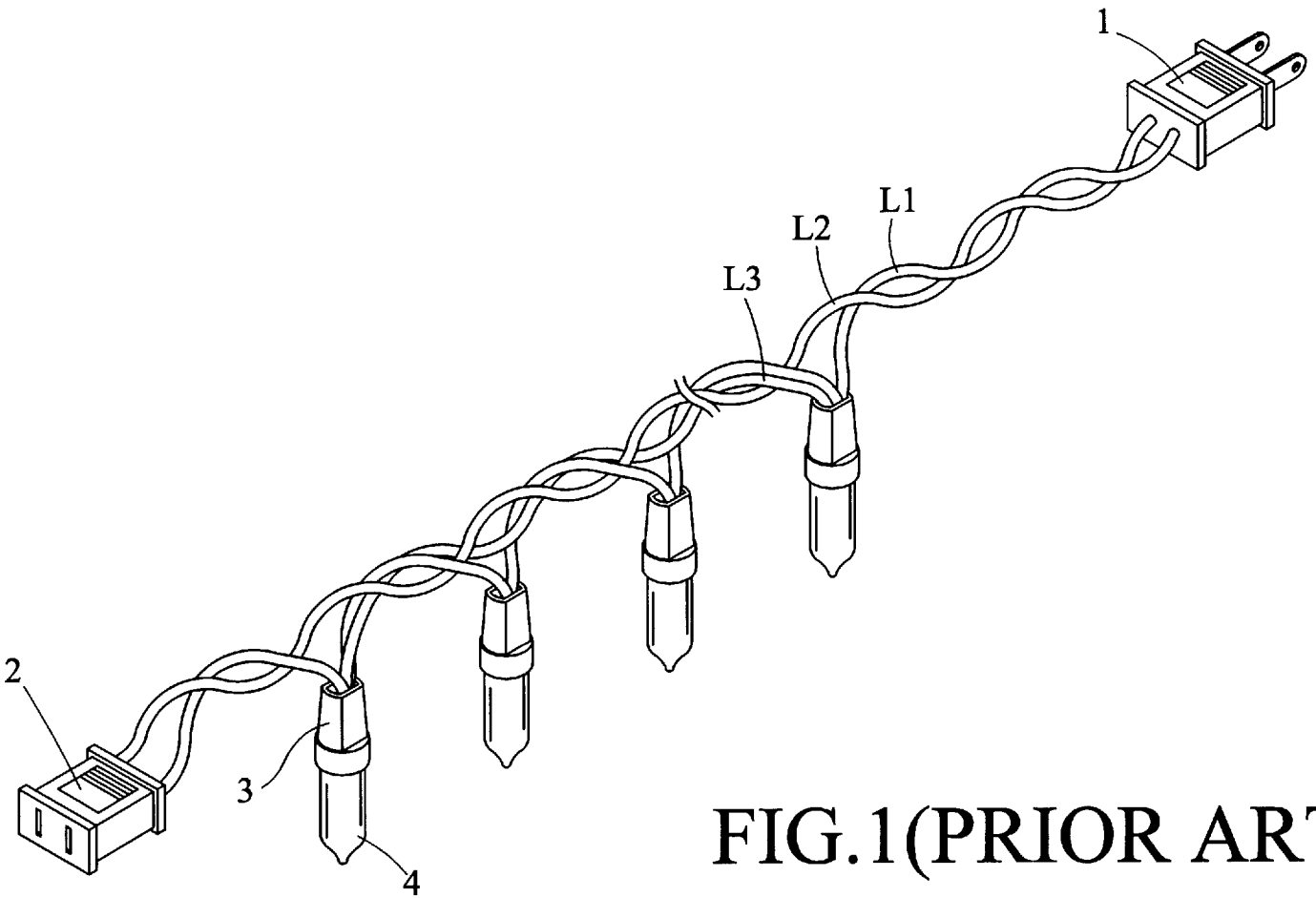
FIG.1(PRIOR ART)
FIG. 1 is a schematic circuit diagram of a conventional Christmas light string.
Figure 2:
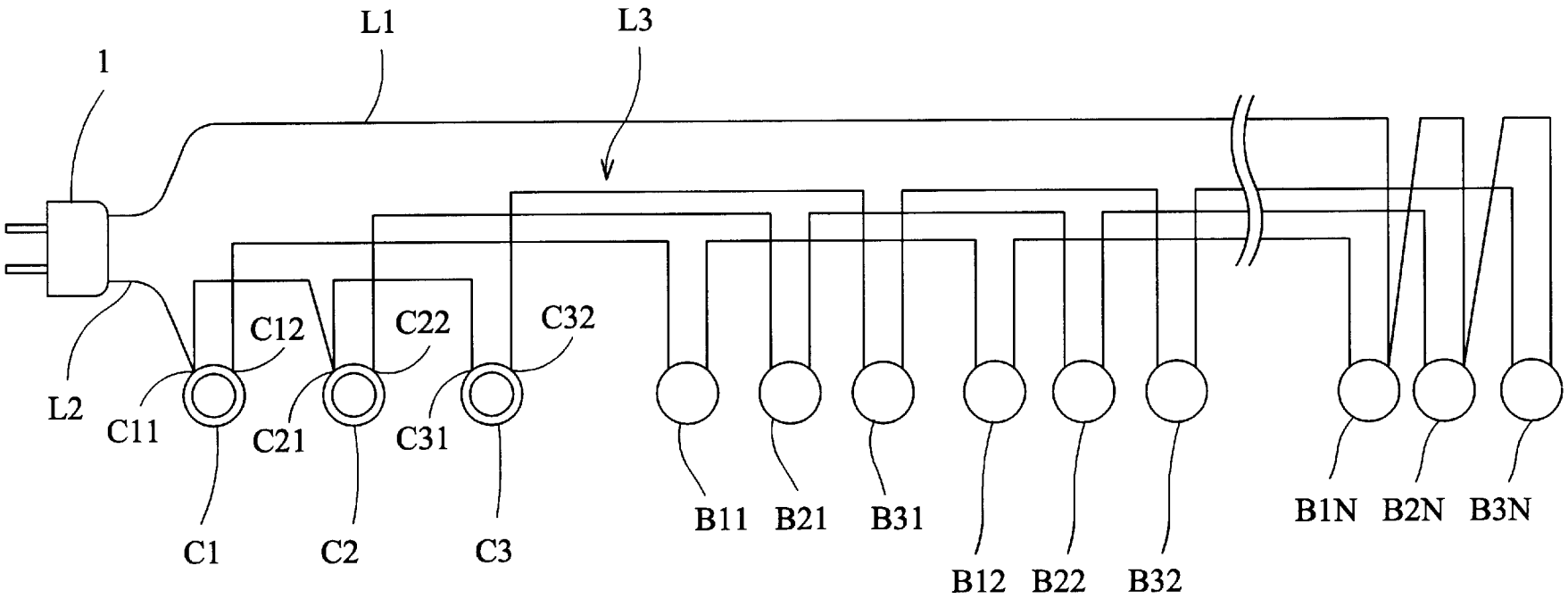
FIG. 2 is a schematic circuit diagram of the decorative light string in accordance with the first embodiment of the present invention.

With reference to FIG. 2, there is shown a schematic circuit diagram of the decorative light string in accordance with the first embodiment of the present invention. The decorative light string of the present invention generally includes an electric plug 1, a first electric power cord L1, a second electric power cord L2, a number of light bulbs, and a number of connecting cords L3 which are used to electrically connect the light bulbs arranged on the light string.

The electric plug 1 may be plugged into an electric receptacle (not shown) for receiving an AC power source. The first electric cord L1, the second electric cord L2, and the adjacent connecting cords are twisted together to form a decorative light string.

In this embodiment, the light bulbs includes three flashing control bulbs C1, C2, and C3 sequentially arranged on the light string at a suitable interval in space. The flashing control bulb is capable of controlling the flashing of the standard light bulbs connected in series to it, which is known in the art. The first flashing control bulb C1 has a first terminal C11 electrically connected to the second electric power cord L2 and a second terminal C12. The second flashing control bulb C2 has a first terminal C21 electrically connected to the first terminal C11 of the first flashing control bulb C1 and a second terminal C22. The third flashing control bulb C3 has a first terminal C31 electrically connected to the first terminal C21 of the second flashing control bulb C2 and a second terminal C32.

In this embodiment, there are three series light strings. The first series light string consists of a plurality of standard light bulbs B11, B12 . . . B1N connected in series and arranged on the decorative light string at a wider interval therebetween. So, the first light bulb B21 of the second series light string and the first light bulb B31 of the third series light string may be arranged between the light bulbs B11 and B12 of the first series light string, as shown in the drawing. One end of the first series light string is connected to the second terminal C12 of the first flashing control bulb C1 and the other end of the light string, i.e. one terminal of the light bulb 1N, is connected to the first electric power cord L1. That is, the first series light string is electrically connected in series with the first flashing control bulb C1 and then connected across the first electric power cord L1 and the second electric power cord L2.

The second series light string consists of a plurality of standard light bulbs B21, B22 . . . B2N connected in series. One end of the light string is connected to the second terminal C22 of the second flashing control bulb C2 and the other end of the light string is connected to the first electric power cord L1. That is, the second series light string is electrically connected in series with the second flashing control bulb C2 and then connected across the first electric power cord L1 and the second electric power cord L2.

The third series light string consists of a plurality of standard light bulbs B31, B32 . . . B3N connected in series. One end of the light string is connected to the second terminal C32 of the third flashing control bulb C3 and the other end of the light string is connected to the first electric power cord L1. That is, the third series light string is electrically connected in series with the third flashing control bulb C3 and then connected across the first electric power cord L1 and the second electric power cord L2.

In such an arrangement, the first, the second, and the third light strings may be controlled by the flashing control bulbs C1, C2, and C3 respectively. Further, the light bulbs of each light string are particularly arranged on the decorative light string in sequence according to the arranged sequence of the flashing control bulbs. So, the decorative light string may present a versatile flashing operation corresponding to the conductive or non-conductive status of the flashing control bulbs. Particularly, the light bulbs arranged on the light string may be controlled by the three control bulbs in a random flashing control manner.

Figure 3:
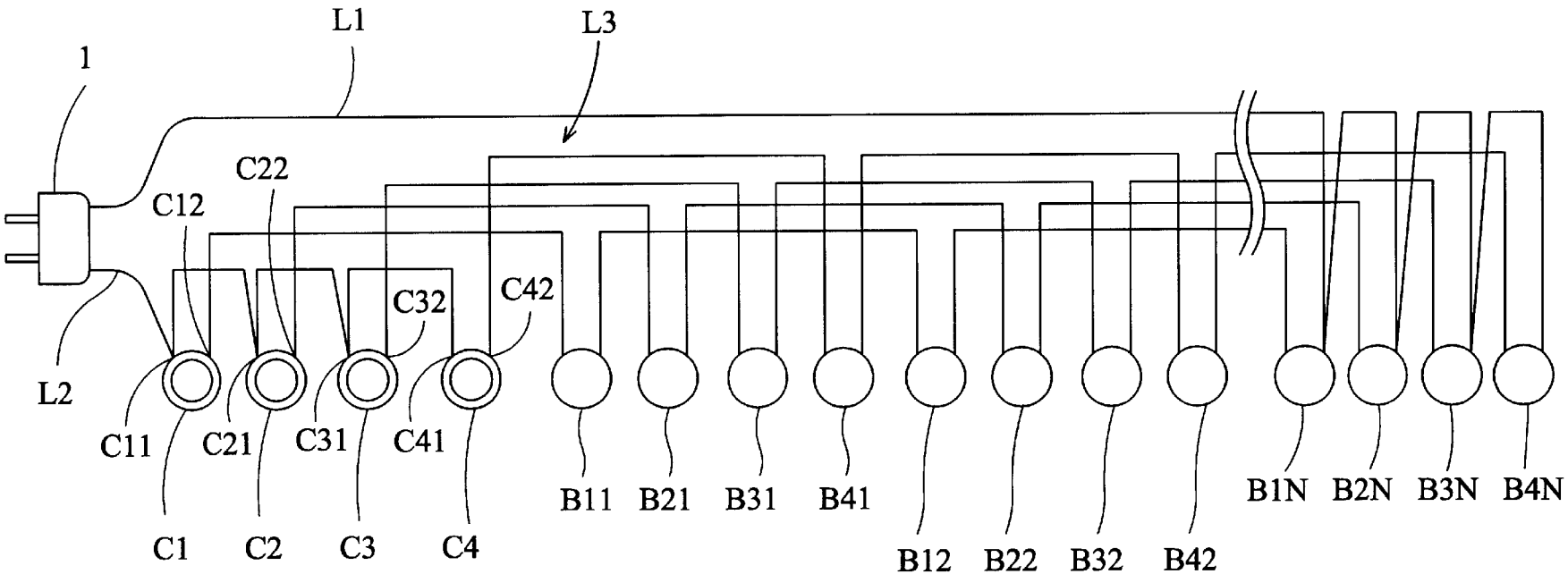
FIG. 3 is a schematic circuit diagram of the decorative light string in accordance with the second embodiment of the present invention.

With reference to FIG. 3, there is shown a schematic circuit diagram of the decorative light string in accordance with the second embodiment of the present invention. The decorative light string of this embodiment is also composed of an electric plug 1, a first electric power cord L1, a second electric power cord L2, a number of light bulbs, and a number of connecting cords L3 for electrically connecting the light bulbs.

In this embodiment, the light bulbs includes four flashing control bulbs C1, C2, C3, and C4 sequentially arranged on the light string at a suitable interval in space. The first flashing control bulb C1 has a first terminal C11 electrically connected to the second electric power cord L2 and a second terminal C12. The second flashing control bulb C2 has a first terminal C21 electrically connected to the first terminal C11 of the first flashing control bulb C1 and a second terminal C22. The third flashing control bulb C3 has a first terminal C31 electrically connected to the first terminal C21 of the second flashing control bulb C2 and a second terminal C32. The fourth flashing control bulb C4 has a first terminal C41 electrically connected to the first terminal C31 of the third flashing control bulb C3 and a second terminal C42.

In this embodiment, there are four series light strings. The first series light string consists of a plurality of standard light bulbs B11, B12, . . . B1N connected in series. One end of the first series light string is connected to the second terminal C12 of the first flashing control bulb C1 and the other end of the light string, i.e. one terminal of the light bulb 1N, is connected to the first electric power cord L1. That is, the first series light string is electrically connected in series with the first flashing control bulb C1 and then connected across the first electric power cord L1 and the second electric power cord L2.

The second series light string consists of a plurality of standard light bulbs B21, B22 . . . B2N connected in series. One end of the light string is connected to the second terminal C22 of the second flashing control bulb C2 and the other end of the light string is connected to the first electric power cord L1. That is, the second series light string is electrically connected in series with the second flashing control bulb C2 and then connected across the first electric power cord L1 and the second electric power cord L2.

The third series light string consists of a plurality of standard light bulbs B31, B32 . . . B3N connected in series. One end of the light string is connected to the second terminal C32 of the third flashing control bulb C3 and the other end of the light string is connected to the first electric power cord L1. That is, the third series light string is electrically connected in series with the third flashing control bulb C3 and then connected across the first electric power cord L1 and the second electric power cord L2.

The fourth series light string consists of a plurality of standard light bulbs B41, B42 . . . B4N connected in series. One end of the light string is connected to the second terminal C42 of the fourth flashing control bulb C4 and the other end of the light string is connected to the first electric power cord L1. That is, the fourth series light string is electrically connected in series with the fourth flashing control bulb C4 and then connected across the first electric power cord L1 and the second electric power cord L2.

In such an arrangement, the first, the second, the third, and the fourth light strings may be controlled by the flashing control bulbs C1, C2, C3, and C4 respectively. Particularly, the light bulbs arranged on the light string may be controlled by the four control bulbs in a random flashing control manner.

In conclusion, from the detail description above, it is obvious that the flashing control circuit of the present invention has versatile flashing features, and therefore meets the requirements of patentability. While the arrangement described above constitutes two preferred embodiments of this invention, it is to be understood that the present invention is not limited to these precise forms and that changes may be made therein without departing from the scope and spirit of the invention as defined in the appended claims.

We claim:

1. A flashing control circuit for a decorative light string having a first electric power cord, a second electric power cord, and an electric plug for supplying an electric power source to the first electric power cord and the second electric power cord, comprising:

a first flashing control bulb having a first terminal and a second terminal, the first terminal of which being connected to the second electric power cord;

a second flashing control bulb having a first terminal and a second terminal, the first terminal of which being connected to the first terminal of the first flashing control bulb;

a third flashing control bulb having a first terminal and a second terminal, the first terminal of which being connected to the first terminal of the second flashing control bulb;

a first series light string consisting of a plurality of light bulbs connected in series, having a first end connected to the second terminal of the first flashing control bulb and a second end connected to the first electric power cord;

a second series light string consisting of a plurality of light bulbs connected in series, having a first end connected to the second terminal of the second flashing control bulb and a second end connected to the first electric power cord; and a third series light string consisting of a plurality of light bulbs connected in series, having a first end connected to the second terminal of the third flashing control bulb and a second end connected to the first electric power cord;

wherein the first, the second, and the third flashing control bulbs are arranged on the decorative light string sequentially at interval and the light bulbs of each light string are arranged on the decorative light string sequentially at interval according to the arranged sequence of the flashing control bulbs.

2. A flashing control circuit for a decorative light string having a first electric power cord, a second electric power cord, and an electric plug for supplying an electric power source to the first electric power cord and the second electric power cord, comprising:

a first flashing control bulb having a first terminal and a second flashing control bulb having a first terminal and a second terminal, the first terminal of which being connected to the first terminal of the first flashing control bulb;

a third flashing control bulb having a first terminal and a second terminal, the first terminal of which being connected to the first terminal of the second flashing control bulb;

a fourth flashing control bulb having a first terminal and a second terminal, the first terminal of which being connected to the first terminal of the third flashing control bulb;

a first series light string consisting of a plurality of light bulbs connected in series, having a first end connected to the second terminal of the first flashing control bulb and a second end connected to the first electric power cord;

a second series light string consisting of a plurality of light bulbs connected in series, having a first end connected to the second terminal of the second flashing control bulb and a second end connected to the first electric power cord;

a third series light string consisting of a plurality of light bulbs connected in series, having a first end connected to the second terminal of the third flashing control bulb and a second end connected to the first electric power cord; and a fourth series light string consisting of a plurality of light bulbs connected in series, having a first end connected to the second terminal of the fourth flashing control bulb and a second end connected to the first electric power cord;

wherein the first, the second, the third, and the fourth flashing control bulbs are arranged on the decorative light string sequentially at interval and the light bulbs of each light string are arranged on the decorative light string sequentially at interval according to the arranged sequence of the flashing control bulbs.

* * * * *